US005803983A

United States Patent [19]

Simandl et al.

[11] Patent Number: 5,803,983

[45] Date of Patent: Sep. 8, 1998

[54] METHOD FOR REMOVING SOLID PARTICULATE MATERIAL FROM WITHIN LIQUID FUEL INJECTOR ASSEMBLIES

[75] Inventors: Ronald F. Simandl, Knoxville; John D. Brown, Harriman; John B. Andriulli, Kingston; Paul D. Strain, Eads, all of Tenn.

[73] Assignee: Lockheed Martin Energy Systems, Inc., Oak Ridge, Tenn.

[21] Appl. No.: 670,869

[22] Filed: Jun. 26, 1996

[51] Int. Cl.[6] ..... B08B 9/00

[52] U.S. Cl. ..... 134/22.12; 134/22.18; 134/26; 134/30; 134/37; 134/39; 134/95.1; 134/95.3; 134/102.2

[58] Field of Search ..... 134/22.12, 26, 134/30, 37, 39, 95.1, 95.3, 102.2, 22.18, 36

[56] References Cited

U.S. PATENT DOCUMENTS 5,119,792 6/1992 Gu ..... 123/533

*Primary Examiner*—Jeffrey Stucker

*Attorney, Agent, or Firm*—Earl L. Larcher

[57] ABSTRACT

A method for removing residual solid particulate material from the interior of liquid fuel injectors and other fluid flow control mechanisms having or being operatively associated with a flow-regulating fixed or variable orifice. The method comprises the sequential and alternate introduction of columns of a non-compressible liquid phase and columns of a compressed gas phase into the body of a fuel injector whereby the expansion of each column of the gas phase across the orifice accelerates the liquid phase in each trailing column of the liquid phase and thereby generates turbulence in each liquid phase for lifting and entraining the solid particulates for the subsequent removal thereof from the body of the fuel injector.

19 Claims, 1 Drawing Sheet

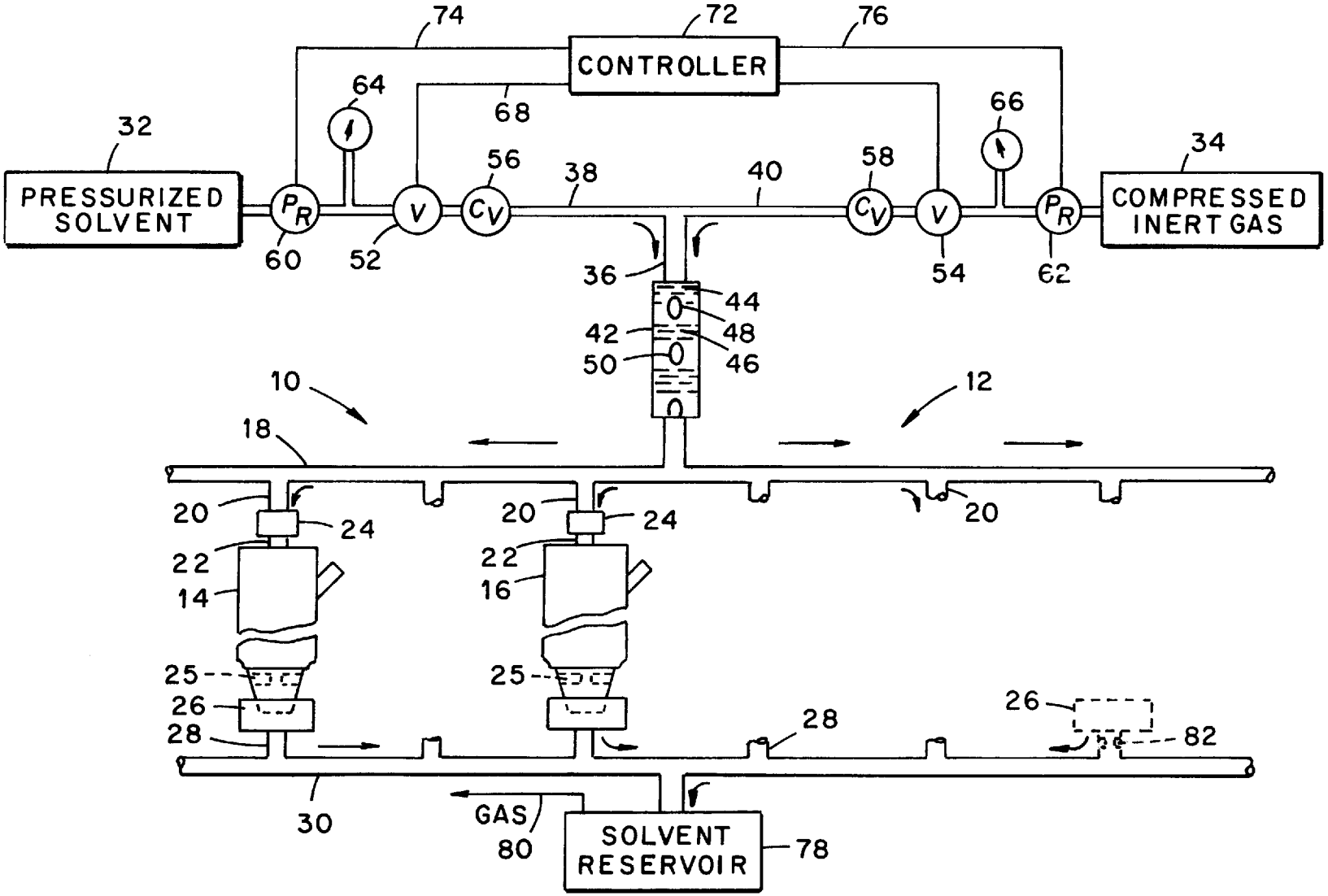
COMPRESSED INERT GAS
PRESSURIZED SOLVENT
CONTROLLER
SOLVENT RESERVOIR
GAS
34
32
62
60
66
64
54
52
58
56
76
72
74
68
40
38
44
48
46
42
50
36
12
10
18
20
22
24
14
16
25
26
28
30
78
80
82

METHOD FOR REMOVING SOLID PARTICULATE MATERIAL FROM WITHIN LIQUID FUEL INJECTOR ASSEMBLIES

This invention was made with the support of the United States Government under contract No. DE-AC05-84OR21400 awarded by the U.S. Department of Energy. The United States Government has certain rights in this invention.

BACKGROUND OF THE INVENTION

The present invention relates generally to the removal of contaminates in the form of solid particulates from internal regions of assembled or partially assembled mechanisms utilized for selectively controlling or regulating the flow of a fluid as defined by a liquid phase or a gas phase. More particularly, the present invention is directed to the method of removing solid particulate material from liquid fuel injector assemblies as utilized in internal combustion engines.

An undesirably high percentage of the liquid fuel injectors of the type used in internal combustion engines fired with a liquid fuel such as gasoline or diesel have failed to function in the intended manner so as to compromise the operation of the engines. A principal cause for many of the fuel injector failures has been found to be due to the retention of solid particulates such as polymer flashing and metal burrs generated during the part manufacturing and part assembly procedures and which remain on fuel contacting surfaces and in cavities within the assembled injector or injector subassemblies. It has been determined that when even one of these residual particulates of a minimal size greater than about 50 micrometers in one direction is dislodged from the internal surface regions or cavities of a fuel injector during the operation of the internal combustion engine and becomes lodged or jammed in a flow controlling opening such as between a ball and seat arrangement of a conventional fuel injector, the engine operation becomes compromised ranging from inefficient engine operation to deleterious damage such as typically caused by a hydraulic lock.

Usually such particulate impairable fuel injectors are not discovered until attached to an engine at the engine assembly plant where the engines are started and tested after the assembly thereof. Thus, since all manufacturers of fuel injectors used in gasoline and diesel engines suffer the consequences of these problems associated with the aforementioned particulate contamination, considerable efforts have been expended to reduce the presence of such particulate contamination in the injectors and thereby effectively reducing the potential for injector failure during the intended use thereof. Such efforts include the assembly of the fuel injectors in clean rooms or under clean-room type conditions and thereafter subjecting the assembled fuel injectors to a "burn-in" period where the injector is operated normally for a selected period. During the burn-in period a substantially non-flammable solvent capable of closely mimicking the fuel is passed through the injector under a pressure in the range of about 5.0 to 100 psi. Following this burn-in period, each injector is calibrated to provide a selected flow, marked by suitable identification, and then shipped to the engine assembly plant for incorporation in an engine. While some residual particulate material is flushed from the fuel injectors during the burn-in period, examinations of such injectors, as especially provided by using working models of the fuel injector formed of clear plastic, indicated the presence of various "dead zones" or cavity regions within the injector where the particulate material was not adequately contacted and flushed from the injector by the flowing solvent. Further, attempts to use ultrasonic and sonic vibrations on the fuel injector during the burn-in period failed to dislodge the particulate from within these dead zones or from other surface regions within the fuel injectors. It was also ascertained during examination of the particulate material recovered from the fuel injector that this particulate material was not air borne as to substantially negate the value of the "clean" environs for reducing particulate contamination during the assembly of the fuel injectors.

SUMMARY OF THE INVENTION

Accordingly, it is a principal aim or objective of the present invention to provide a method for significantly reducing the number of fuel injector failures as caused by the presence of residual solid particulate material generated during the manufacture and/or assembly of the fuel injector assemblies or subassemblies and supported on internal surface regions or in fuel contacting cavities or zones . In accordance with this goal of the present invention, it was found that the failure rate of one type of assembled fuel injectors could be significantly reduced from about 60 units per million to about 18 units per million by practicing the method of the present invention on the fuel injectors prior to the use thereof in an assembled engine.

Generally, the method of the present invention is useful for removing solid particulate material lodged within internal cavities and supported by internal surface regions of any assembled or partially assembled fluid flow control means utilizable for controlling the flow of a fluid being passed therethrough and having fluid inlet means and fluid outlet means. The present method comprises the steps of: alternately introducing into the inlet means of the flow control means a stream of compressed gas and a stream of liquid for contact with the particulate-containing cavities and the particulate-supporting internal surface regions, sequentially discharging the alternately introduced stream of the gas and the stream of the liquid from the fluid flow control means through the outlet means, and establishing a flow restriction in close proximity to the outlet means of a size adequate for the passage of any of the solid particulate material and adequate to effect sufficient expansion of the compressed gas stream to accelerate the following stream of the liquid towards the outlet means for producing an adequate level of turbulence in the liquid stream to dislodge and entrain solid particulate material contacted thereby for the removal thereof from the particulate-containing cavities and the particulate-supporting internal surface regions of the fluid flow control means.

In the present method, it is preferable to utilize a plurality of streams of the liquid that are sequentially and alternately introduced with a like plurality of streams of the compressed gas whereby each of the plurality of liquid streams is provided with the solid particulate-dislodging turbulence by the expansion of a preceding gas stream. Each stream of the liquid is introduced into the inlet means of the fluid flow control means for a duration sufficient to provide a volume of liquid adequate to provide turbulent contact thereof with substantially all of the particulate-supporting surface regions and the particulate-containing cavities. Also, the alternate and sequential introduction of the liquid streams and the gas streams is maintained for a duration adequate to remove substantially all of the solid particulate material contacted by turbulent liquid streams from the particulate-supporting surfaces and dead zones in the fluid flow control means.

The stream of the compressed gas introduced into inlet means of the fluid flow control means is at a pressure that is sufficiently high so that upon the expansion thereof across the flow restriction the stream of liquid will be adequately accelerated towards the outlet means to generate sufficient turbulence in the liquid stream to effect the desired dislodging and entrainment of the solid particulate material contacted thereby. Also, the pressure of the liquid stream introduced into the inlet means substantially corresponds to the pressure of the stream of compressed gas. These pressures are in the range of about 5 to 200 psi.

It will appear clear from this description and the appending claims that while the present invention is primarily directed to the removal of solid particulate material from liquid fuel injectors as utilized for internal combustion engines, the method of the present invention can also be utilized to remove residual solid particulate material from within any assembled or partially assembled fluid flow control means or mechanism having internal surface regions and cavities capable of supporting residual particulates which is utilized for the selective control of the flow of the fluid in the form of a liquid phase or a gas phase, and which preferably contains a variable or fixed orifice or flow restrictor capable of providing the pressure drop in the expanding gas phase needed for generating adequate particulate-removing turbulence in the accelerated liquid phase. For example, various valves, pressure regulators, flow metering devices, sensors utilizing fluid flow, and the like, house dislodgeable residual solid particulate material which could readily interrupt or otherwise detract from the desired operation of such fluid flow control mechanisms.

In the event the assembled or partially assembled fluid flow control mechanism does not contain a variable or fixed orifice or flow restrictor or one that is readily capable of providing a sufficient pressure drop in the expanding gas phase, the apparatus used to practice the present invention, as described below, could be readily modified to establish and position a fixed or variable flow restriction at a location in the apparatus piping sufficiently near the outlet of the fluid flow control mechanism so as to provide the pressure drop desired for the expanding gas phase. In fact, it is expected that the manufacture of a relatively large number of fluid flow control mechanisms such as liquid fuel injectors, could be facilitated by simply adjusting the fluid flow controlling device or devices provided therein to a wide or near wide open setting and then using a flow restriction established by the apparatus used to practice the method to provide the desired pressure drop in the expanding gas phase. This procedure would also obviate the requirement of adjusting the flow restriction in each fuel injector or other flow control mechanism to a setting sufficient to provide the required pressure drop in the expanding gas phase.

Other and further objects of the present invention will become obvious upon an understanding of the illustrative method and an apparatus for practicing the method about to be described or will be indicated in the appended claims, and various advantages not referred to herein will occur to one skilled in the art upon employment of the invention in practice.

DESCRIPTION OF THE DRAWINGS

The figure is a schematic representation of a manifolded apparatus which can be used to practice the method of the present invention for effectively and simultaneously removing solid particulate material from within internal regions of a plurality of liquid fuel injectors.

An apparatus for practicing the preferred embodiment of the method of the invention has been chosen for the purpose of illustration and description. The apparatus illustrated is not intended to be exhaustive nor to limit the invention to the practice thereof with the precise form of apparatus shown. The apparatus is chosen and described in order to best explain the principles of the invention and their application and practical use to thereby enable others skilled in the art to best utilize the various method steps of the invention as well as modifications of these method steps as are best adapted to the particular use contemplated. Also, while the figure shows a manifold arrangement with a plurality of stations for effecting the simultaneous removal of particulate flow from liquid fuel injectors, it will appear clear that an apparatus could be readily constructed to treat a single fuel injector or other fluid flow control mechanisms. Further, while the fuel injector is shown as being fully assembled, it will appear clear that fuel injector subassemblies can also be readily treated by the method of the present invention for effectively removing therefrom potentially damaging particulate material.

DETAILED DESCRIPTION OF THE INVENTION

As briefly described above, the present invention is generally directed to a method for dislodging solid particulate material resulting from the manufacture and assembly of mechanisms utilized for controlling or regulating the flow of a fluid defined by a pressurized or non-pressurized liquid phase or gaseous phase and, more specifically, to such mechanisms as provided by liquid fuel injectors of the type used in gasoline engines and diesel engines. The present invention could also be used to clean fuel injectors of the type utilized in external combustion engines such as gas turbine engines so as to considerably reduce operational problems of such engines due to particulate plugged or jammed fuel injectors. Thus, for the purpose of this description, and while the preferred embodiment of the method described below is with respect to the removal of particulate material from a liquid fuel injector as utilized in an internal combustion engine, the method described below can be equally used for the removal of particulate material from any flow control valve, pressure regulator, metering device, sensors using fluid flow, and the like which are constructed and designed so as to function within a narrow range of operational tolerances, which require precise positioning of internal flow controlling components during the operation thereof, and which preferably contain a variable or fixed orifice which can be sized to provide the pressure drop in the gas phase needed to generate sufficient turbulence in the liquid phase to effect the desired particulate removal.

In accordance with the present invention residual solid particulate contaminants or material that remain within the fuel injector after partial assembly or complete assembly of the fuel injector during the manufacturing thereof and are removed from fuel injector assembly or subassembly prior to the intended use thereof. Briefly, this removal of the internally trapped residual particulate material is achieved by utilizing a method incorporating an "air-hammer"-like effect as provided by selectively introducing into the injector body alternate streams or columns of a compressed gas phase and a pressurized liquid phase with the rapid expansion of the compressed gas phase upon the discharge thereof from the injector body via a pressure drop generating the air-hammer effect.

In the practice of the present invention the pressures of the non-compressible liquid phase and the compressed gas phase, each preferably if possible, at best substantially correspond to the working pressures of the particular fluid phase utilized in the operation of the fluid flow control mechanism. However, the pressures of the liquid and gas phases utilized in the present method must be sufficient to assure that adequate turbulence is generated in the liquid phase when accelerated by the expanding gas phase to dislodge essentially all, if not all, of the dislodgeable solid particulate material from the fuel-contacting internal surface regions and cavities including the so-called dead zones. In the present method including the preferred embodiment thereof, satisfactory results have been achieved by using streams of the liquid phase and the gas phase at pressures closely corresponding to one another and in a range of about 5 to 200 psi.

The streams of the gas phase alternately introduced into the injector body with the streams of liquid phase are introduced at a rate and duration sufficient to assure that an adequate volume defining each of the compressed gas phase streams or columns thereof is introduced ahead of each stream or column of the pressurized liquid phase to generate the turbulence in the accelerated liquid phase needed for the desired removal of the particulate material. Also, the volume of each liquid phase stream or column introduced behind each stream of compressed gas phase must also be sufficient to assure that the turbulence generated therein will engage and dislodge as well as entrain the dislodged particulate solid material for, preferably, the subsequent flushing thereof from the injector body. Satisfactory results are expected to be achieved with known fluid flow control mechanisms, including fuel injectors, by maintaining the flow of each of the gas phase and the liquid phase for a duration in the range of about 0.5 to about 10.0 seconds.

The duration required for treating each of the fluid flow control mechanisms in accordance with the present method depends upon the particular construction and operation of the fluid flow control mechanism being treated, the concentration and location of the solid particulate material therein, the extent of work needed by the turbulent liquid phase for dislodging the solid particulates, and the level of particulate-free environs desired for the fluid flow control mechanism. Usually, subjecting the fluid flow control mechanism to the alternate flows of the liquid phase and the gas phase for a duration in the range of about 1.0 to about 20 minutes will provide a satisfactory level of particulate removal. In the preferred embodiment of the method of the present invention, each stream of the gas phase is alternated with each stream of the liquid phase about every 1.0 to 2.0 seconds for a total treatment duration in the range of about 5 to about 10 minutes.

The non-compressible liquid phase used for removing the solid particulates can be the same as the working fluid controlled by the flow control mechanism during its intended use or any other suitable liquid phase. Preferably, such a suitable liquid phase is one which substantially mimics the working liquid so as to not contaminate or adversely react with the components of the fluid flow control mechanism. Depending on the particular construction of the flow control mechanism and its intended use, satisfactory results can be achieved by using a liquid phase such as water (preferably with corrosion inhibitors), hydrocarbon liquids, solvents, or any other suitable liquid. In the preferred embodiment of the present invention, the liquid phase is preferably a non-flammable or substantially non-flammable liquid which closely mimics the other properties of the fuel used in the fuel injectors. For example, in the removal of particulates from fuel injectors of the type used in gasoline engines, Stoddard solvent can be satisfactorily used as the liquid phase.

The compressible gas phase used in the practice of the present invention can be selected from any of several gases or mixtures of various gases depending upon the particular use contemplated for the flow control mechanism and the liquid phase used in conjunction with the compressible gas phase. Also, the compressible gas phase so selected should be one which will not contaminate the flow control mechanism or adversely react with the liquid phase or the components of the flow control mechanism. In conforming to these requirements, the compressible gas phase can be satisfactorily formed of oxygen, oxygen-containing gases such as air, carbon dioxide, and the like or from an inert gas or gases such as argon, nitrogen, helium, and the like. In the practice of the preferred embodiment, the compressible gas phase used with the gasoline-mimicking liquid phase is such an inert gas or a mixture thereof so as to prevent the formation of an explosive or flammable environment during the practice of the present invention.

In order to provide a more facile understanding of the method of the present invention the preferred embodiment of the method as directed to the removal of solid particulates from liquid fuel injectors for gasoline engines and as well as an apparatus suitable for the practice of this method are described in detail below.

With reference to the figure in the accompanying drawing, the apparatus generally illustrated at 10 is used for the satisfactory practice of the method of the present invention and is shown comprising a manifold system 12 having multiple fuel injector treating stations, each designed to receive and support an assembled fuel injector such as generally shown at 14 and 16. The manifold system 12 is defined by a primary gas and liquid phase supplying conduit 18 with secondary supply conduit sections 20 at each station coupled to the primary conduit 18 and connected to the inlet end 22 of each fuel injector 14 and 16. The connection between the inlet of each fuel injector and each conduit section 20 being preferably achieved by using a conventional fluid-tight quick connect-disconnect connector as shown generally at 24. The discharge end or outlet 25 of each fuel injector 14 or 16 (shown for the purpose of this description with a restricted orifice as required for the practice of the present method) is preferably coupled via a quick connect-disconnect connector 26 to a secondary discharge conduit section 28 which in turn is coupled to the primary discharge conduit 30 of the manifold system 12.

A supply or source 32 of a pressurized suitable non-flammable or substantially non-flammable solvent such as "Stoddard" solvent which closely mimics the properties of gasoline and a separate supply or source 34 of a suitable compressed inert gas such as nitrogen, helium, argon, or mixtures thereof are each coupled to the main supply conduit 18 via a T-shaped conduit arrangement formed of a base section 36 and upper arm sections 38 and 40. This liquid phase and this gas phase can be pressurized to provide the desired operational pressures in the range of about 5 to 200 psi in the fuel injectors by using any suitable liquid phase and gas phase pressurizing mechanisms. The apparatus 10 is shown provided with a sight glass 42 in the base section 38 to provide a visual observation of the discrete charges of the liquid phase as generally shown at 44 and 46 and the alternately introduced charges of the compressed gas phase as shown at 48 and 50. These discrete charges or streams of the liquid phase and the gas phase are provided by alternately actuating the flow control valves 52 and 54 in conduits 38 and 40 for a selected duration in the range of about 1.0 to about 2.0 seconds over about a 5 to 10 minute period. Also shown are check valves 56 and 58 contained in the conduits 38 and 40 near the intersection with the base section 38 for inhibiting any flow of the liquid phase into the gas phase supply or vice versa during any pressure differential between the two phases. The pressure regulator valves 60 and 62 are shown placed in the conduit sections 38 and 40 to provide the liquid phase and the gas phase with the desired operational pressures in the aforementioned range. A visual observation of such pressures may be provided by the use of pressure gauges such as shown at 64 and 66 attached to the conduit sections 38 and 40 downstream of the pressure regulators 60 and 62.

The flow control valves 52 and 54 may be of any suitable conventional type such as a ball valve, rotary valve, simple gate valve, etc. and which can be operated manually or automatically such as by using a solenoid-type on-off valve actuator (not shown) that is coupled by lines 68 and 70 to a suitable processor or controller 72. Similarly, the pressure regulating valves 60 and 62 can be of any suitable type and construction and can be operated manually or automatically by employing valve operating signals from the controller 72 via lines 74 and 76.

A solvent reservoir 78 is shown coupled to the primary discharge conduit 30 of the manifold system 12 to receive the particulate-bearing solvent discharged from the injectors. A vent line 80 is shown coupled to the reservoir 78 for permitting the inert gas to be discharged from the system. If desired, this gas can be collected and recycled for practicing the present method. However, since the solvent will contain solid particulate material flushed from the injectors any subsequent use of this solvent will require the use of a thorough screening operation.

In an example of the preferred embodiment of the present invention, fuel injectors such as shown at 14 and 16 were formed of clear plastic and preloaded with solid metallic and/or polymer particulates in a size range of about 100 micrometers so as to substantially conform with the size, type, and quantity of particulate contaminates which can be expected to occur during a normal fuel injector manufacturing operation. The so-loaded fuel injectors were attached to the various stations of the manifold system 12 by using the quick connect-disconnect couplings 24 and 26 and are set up so that the variable orifices, such as between the ball and the seat and generally shown in outlet 25, feed were held open to provide an opening therethrough of at least to about 100 micrometers in size so as to assure that during the particulate removing operation the necessary pressure drop in the gas phase can be achieved to provide the turbulence in the liquid phase and yet, preferably, be sufficiently large to permit the flushing of entrained particulate material. The so-mounted fuel injectors were then subjected to alternately delivered streams of Stoddard solvent at 40 psi and streams of nitrogen gas, compressed to essentially the same pressure as the solvent, by alternately actuating or cycling the valves 56 and 58 each second for a duration of 10 minutes. An examination of the fuel injectors during the particulate removing operation showed that the liquid-phase hammer effect provided by the alternately delivered liquid non-compressible liquid phase and the compressible gas phase lifted or scrubbed the particulate material from the internal surface regions and the dead zones and entrained this so-removed particulate material and thus provided for the effective removal of substantially all of the so-contacted particulate material from the particulate-bearing surfaces and dead zones of the injectors.

As briefly described above, the flow restriction for providing the desired pressure drop in the expanding gas phase could be provided in the secondary discharge conduit sections 28 at a location generally underlying the quick connect-disconnect connectors 26 so as to obviate the need for effecting the relatively precise adjustments to the openings in the flow control devices utilized in the fuel injector as required to provide both the needed pressure drop in the expanding gas phase and the passage of dislodged particulate material. This use of a flow restriction in the apparatus conduit sections would also permit the present method to be practiced on fluid flow control mechanisms which do not have the required fluid flow restrictions, which do not have fluid flow restriction that are properly located in the mechanism, or which are not readily adjustable to provide the desired pressure drop in the expanding gas phase. Such a flow restriction is shown in phantom at 82 in the conduit section 28. This flow restriction 82 is preferably provided by a variable orifice, and more preferably, a variable orifice which can be readily adjusted in size such as by the utilization of a signal from the controller 72.

It will be seen that the present invention provides a novel method for removing particulate matter from internal surfaces and cavities of fluid flow control mechanisms whereby the potential, problem-causing residual particulates can be effectively removed therefrom prior to the usage of the fluid flow control mechanism in an intended manner in a working system and thereby increasing the reliability of the entire system as well as significantly reducing the cost and number of system shut-downs caused by failures of the system-containing flow mechanisms due to a particulate-jammed component therein.

What is claimed is:

1. A method for removing solid particulate material lodged within internal cavities and supported on internal surface regions of a fluid flow control means utilizable for controlling the flow of a fluid being passed therethrough and having fluid inlet means and fluid outlet means, comprising the steps of alternately introducing into the inlet means of the fluid flow control means a stream of compressed gas followed by a stream of a pressurized liquid for contact with the particulate-containing cavities and the particulate-supporting internal surface regions, sequentially discharging the alternately introduced stream of the gas and the stream of the liquid from the fluid flow control means through the outlet means, and establishing a flow restriction in close proximity to the outlet means with said flow restriction being of a size adequate to effect a sufficiently rapid expansion of the compressed gas stream to sufficiently accelerate the stream of the liquid following the expanding gas stream towards the outlet means for producing adequate turbulence in the liquid stream while within the fluid flow control means and in contact with the particulate-containing cavities and the particulate-supporting internal surface regions to dislodge and entrain solid particulate material contacted thereby for the removal thereof from the particulate-containing cavities and the particulate-supporting internal surface regions of the fluid flow control means.

2. The method for removing solid particulate material from a fluid flow control means of claim 1, wherein the fluid is a liquid phase.

3. The method for removing solid particulate material from a fluid flow control means of claim 1, wherein the fluid is a gas phase.

4. The method for removing solid particulate material from a fluid flow control means of claim 1, wherein a plurality of streams the liquid are sequentially and alternately introduced with a plurality of streams of the compressed gas whereby each of the plurality of liquid streams is provided with the solid particulate-dislodging turbulence by the expansion of an immediately preceding gas stream.

5. The method for removing solid particulate material from a fluid flow control means of claim 4, including the additional step of maintaining the alternate introduction of the liquid stream and the gas streams for a duration adequate to remove substantially all of the solid particulate material contacted by the plurality of turbulent liquid streams from the particulate-containing cavities and the particulate-supporting internal surface regions of the fluid flow control means.

6. The method for removing solid particulate material from a fluid flow control means of claim 1, wherein the stream of the compressed gas is introduced into inlet means of the fluid flow control means at a pressure adequate upon the expansion thereof across the flow restriction to sufficiently accelerate the stream of liquid towards the outlet means to generate sufficient turbulence in the liquid stream to effect the dislodging and entrainment of the solid particulate material contacted thereby.

7. The method for removing solid particulate material from a fluid flow control means of claim 6, wherein the liquid stream introduced into the inlet means is at a pressure substantially corresponding to the pressure of the stream of compressed gas.

8. The method for removing solid particulate material from a fluid flow control means of claim 7, wherein the stream of liquid and the stream of compressed gas are each at pressure in the range of about 5 to 200 psi.

9. The method for removing solid particulate material from a fluid flow control means of claim 1, wherein the stream of the liquid is introduced into the inlet means of the fluid flow control means for a duration sufficient to provide a volume of liquid adequate to provide turbulent contact thereof with substantially all of the particulate-supporting surface regions and the particulate-containing cavities.

10. The method for removing solid particulate material from a fluid flow control means of claim 2, wherein the liquid in the liquid stream is substantially inert with respect to the gas in the gas stream, materials forming the fluid flow control means, and the liquid phase controlled by the fluid flow control means.

11. The method for removing solid particulate material from a fluid flow control means of claim 10, wherein the liquid in the liquid stream substantially mimics the liquid phase controlled by the fluid flow control means.

12. The method for removing solid particulate material from a fluid flow control means of claim 11, wherein the gas in the gas stream is substantially inert with respect to the liquid in the liquid stream, materials forming the fluid flow control means, and the liquid phase controlled by the fluid flow control means.

13. The method for removing solid particulate material from a fluid flow control means of claim 3, wherein the liquid in the liquid stream is substantially inert with respect to the gas in the gas stream, materials forming the fluid flow control means, and the gas phase controlled by the fluid flow control means.

14. The method for removing solid particulate material from a fluid flow control means of claim 13, wherein the gas in the gas stream is substantially inert with respect to the liquid in the liquid stream, materials forming the fluid flow control means, and the gas phase controlled by the fluid flow control means.

15. The method for removing solid particulate material from a fluid flow control means of claim 14, wherein the gas in the gas stream substantially mimics the gas phase controlled by the fluid flow control means.

16. The method for removing solid particulate material from a fluid flow control means of claim 12, wherein the fluid flow control means is a liquid fuel injector.

17. The method for removing solid particulate material from a fluid flow control means of claim 16, wherein the liquid phase is gasoline, wherein the liquid in the liquid stream is a substantially non-flammable solvent mimicking gasoline, and wherein the gas in the gas stream is an inert gas comprising nitrogen, argon, helium, or mixtures thereof.

18. The method for removing solid particulate material from a fluid flow control means of claim 1, wherein the step of establishing the flow restriction at a location in close proximity to the outlet means is provided by selectively varying the spacing between ball means and seat means supported by the liquid fuel injector.

19. The method for removing solid particulate material from a fluid flow control means of claim 1, wherein the step of establishing the flow restriction includes providing the latter with an opening adequate for the passage of entrained solid particulate material while maintaining the flow restriction at said size.

* * * * *